US010818429B2

(12) United States Patent
Yen et al.

(10) Patent No.: US 10,818,429 B2
(45) Date of Patent: Oct. 27, 2020

(54) INDUCTOR DEVICE

(71) Applicant: Realtek Semiconductor Corporation, Hsinchu (TW)

(72) Inventors: Hsiao-Tsung Yen, Hsinchu (TW); Chih-Hua Liu, Hsinchu County (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 74 days.

(21) Appl. No.: 15/868,993

(22) Filed: Jan. 11, 2018

(65) Prior Publication Data

US 2019/0035544 A1 Jan. 31, 2019

(30) Foreign Application Priority Data

Jul. 31, 2017 (TW) ..... 106125767 A

(51) Int. Cl.

| | |
|---|---|
| ***H01F 29/00*** | (2006.01) |
| ***H01F 27/28*** | (2006.01) |
| ***H01F 27/29*** | (2006.01) |
| ***H01F 29/02*** | (2006.01) |

(52) U.S. Cl.

CPC ..... *H01F 29/025* (2013.01); *H01F 27/2823* (2013.01); *H01F 27/29* (2013.01)

(58) Field of Classification Search

CPC .... H01F 27/29; H01F 29/029; H01F 27/2823; H01F 29/025

See application file for complete search history.

(56) References Cited

U.S. PATENT DOCUMENTS 6,476,704 B2 * 11/2002 Goff ..... H01F 17/0006 29/602.1
6,974,740 B2 * 12/2005 Lowther ..... H01L 23/5225 438/214
7,132,946 B2 * 11/2006 Waldner ..... G06K 19/0707 340/572.1
7,259,649 B2 * 8/2007 Ancey ..... H01F 17/0006 336/200

(Continued)

FOREIGN PATENT DOCUMENTS

CN 102543361 A 7/2012
CN 102655139 A 9/2012

(Continued)

OTHER PUBLICATIONS

The office action of the corresponding Chinese application No. CN201710659636.0 dated Aug. 26, 2019 with its English abstract.

*Primary Examiner* — Elvin G Enad
*Assistant Examiner* — Malcolm Barnes
(74) *Attorney, Agent, or Firm* — CKC & Partners Co., LLC

(57) ABSTRACT

An inductor device includes at least two wires and at least two switches. Each of the at least two wires includes an opening, and the openings are disposed correspondingly to each other. One of the at least two switches is coupled to two terminals of the opening of one of the at least two wires. Another one of the at least two switches is coupled to one terminal of the opening of the one of the at least two wires and one terminal of the opening of another one of the at least two wires in an interlaced manner. If the one of the at least two switches is turned on, one of the at least two wires forms an inductor; if another one of the at least two switches is turned on, both of the at least two wires form the inductor.

20 Claims, 9 Drawing Sheets

(56) References Cited

U.S. PATENT DOCUMENTS 7,372,352 B2 * 5/2008 Lee ..... H01F 21/12 336/200
7,808,356 B2 * 10/2010 Papananos ..... H01F 27/2804 336/200
7,990,220 B2 * 8/2011 Kondo ..... H03F 1/0272 330/276
8,044,756 B2 * 10/2011 Fahs ..... H01F 17/0006 336/200
8,145,160 B2 * 3/2012 Kim ..... H04B 1/006 330/124 R
8,531,250 B1 * 9/2013 Luschas ..... H03B 5/1228 257/531
8,742,880 B2 * 6/2014 Kim ..... H03B 5/1228 336/200
8,928,405 B2 * 1/2015 Gramegna ..... H03F 1/565 330/195
9,276,056 B2 * 3/2016 Akhtar ..... H01L 23/66
9,385,650 B2 * 7/2016 Shi ..... H03H 7/09
9,934,898 B2 * 4/2018 Mattsson ..... H01F 21/12
10,074,472 B2 * 9/2018 Wang ..... H01F 27/362
10,438,735 B2 * 10/2019 Zhang ..... H01F 27/2804
2002/0130387 A1 * 9/2002 Carpentier ..... H01L 27/08 257/531
2005/0052272 A1 * 3/2005 Tiebout ..... H01F 17/0006 336/232
2006/0033587 A1 2/2006 Cabanillas
2007/0052512 A1 3/2007 Jeon et al.
2008/0129434 A1 * 6/2008 Khajehpour ..... H01F 21/12 336/139
2009/0201100 A1 * 8/2009 Kossel ..... H03H 7/185 333/138
2012/0223796 A1 * 9/2012 Huang ..... H01F 21/12 336/142
2012/0244802 A1 * 9/2012 Feng ..... H04B 5/0087 455/41.1
2013/0082810 A1 * 4/2013 Feng ..... H01F 29/02 336/145
2015/0348702 A1 12/2015 Yen et al.
2016/0217904 A1 * 7/2016 Vanukuru ..... H01F 17/0006
2016/0254084 A1 * 9/2016 Nilsson ..... H03J 5/246 455/77
2016/0268994 A1 * 9/2016 Granger-Jones ..... H01F 38/14
2016/0343502 A1 11/2016 Yen et al.
2017/0140865 A1 * 5/2017 Stamper ..... H01F 27/2804
2017/0287618 A1 * 10/2017 Knopik ..... H01F 27/2804
2018/0277480 A1 * 9/2018 Kang ..... H01L 23/66

FOREIGN PATENT DOCUMENTS

KR 10-2004-0080727 A 9/2004
TW 201237895 A1 9/2012

* cited by examiner

INDUCTOR DEVICE

RELATED APPLICATIONS

This application claims priority to Taiwan Application Serial Number 106125767, filed Jul. 31, 2017, which is herein incorporated by reference.

BACKGROUND OF THE INVENTION

Field of Invention

The present disclosure relates to basic electronical elements. More particularly, the present disclosure relates to an inductor device.

Description of Related Art

The various inductors nowadays have advantages and disadvantages. For instance, a spiral type inductor has higher Q value and large mutual inductance if it is designed correctly. However, the mutual inductance and the coupling condition of the spiral type inductor occurs amongst its coils. When it comes to a 8-shaped inductor, the mutual inductance and the coupling condition occur at another coil of the 8-shaped inductor since magnetic orientations of two coils of an 8-shaped inductor are opposite. Furthermore, 8-shaped inductor occupies more space in a device other than another type of inductor. Therefore, the applications of the spiral type inductor and the 8-shaped inductor are limited.

DETAILED DESCRIPTION

Figure 1:
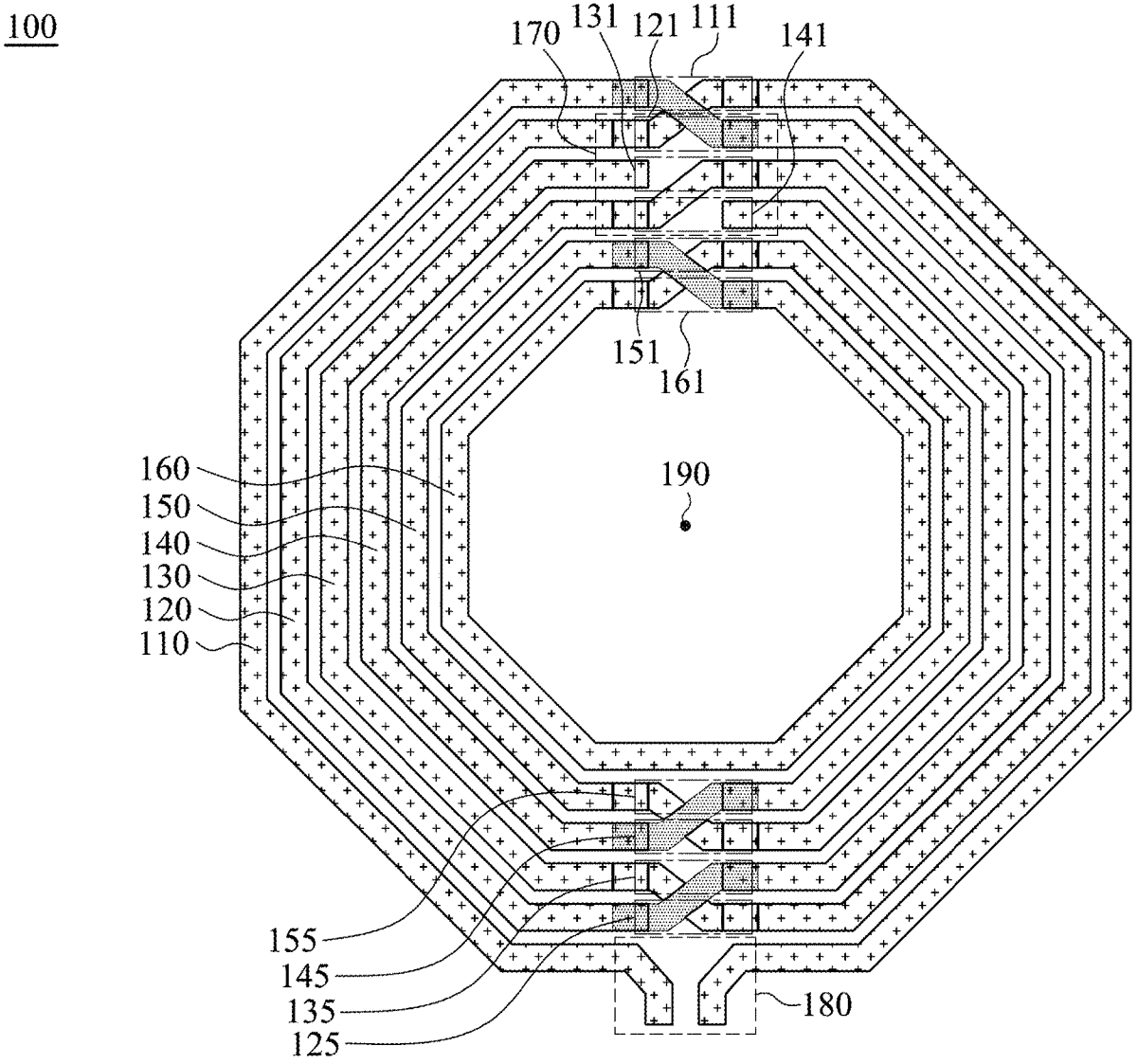
FIG. 1 is a schematic diagram of an inductor device according to some embodiments of the present disclosure.
Figure 2:
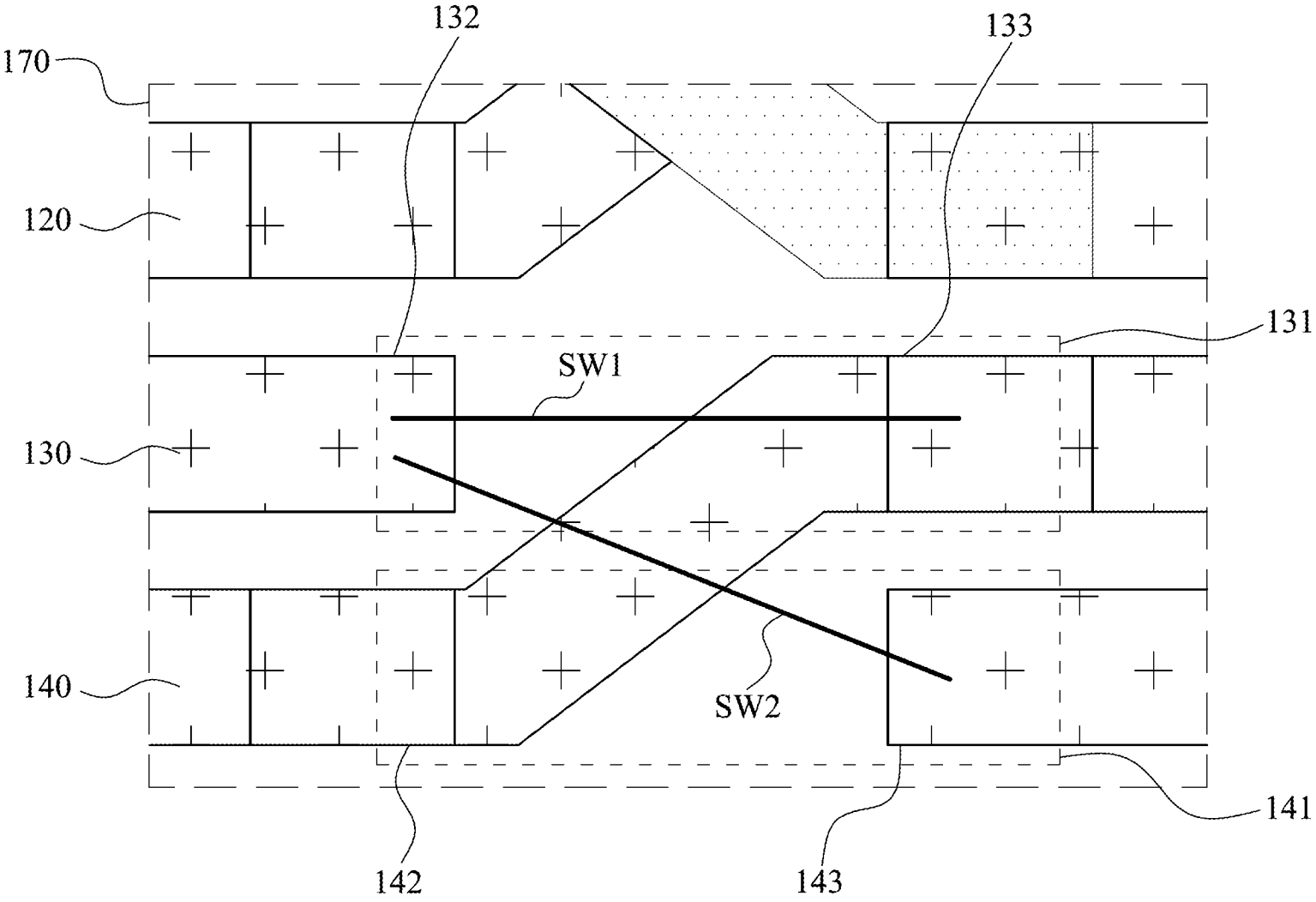
FIG. 2 is a schematic diagram of part of a circuit of an inductor device as shown in FIG. 1 according to some embodiments of the present disclosure.

FIG. 1 is a schematic diagram of an inductor device 100 according to some embodiments of the present disclosure. FIG. 2 is a schematic diagram of part of a circuit 170 of the inductor device 100 as shown in FIG. 1 according to some embodiments of the present disclosure. Reference is made to both FIG. 1 and FIG. 2, in one embodiment, the inductor device 100 includes at least two wires (e.g., wires 130, 140) and at least two switches (e.g., switches SW1, SW2). Each of the at least two wires (e.g., wires 130, 140) includes an opening (e.g., openings 131, 141), and the openings are disposed correspondingly to each other (i.e., openings 131, 141 are all disposed at the upper side of the inductor device 100, and are disposed adjacent to each other). One of the at least two switches (e.g., switch SW1) is coupled to two terminals of the opening of one of the at least two wires (e.g., two terminals 132, 133 of the opening 131 of the wire 130), and another one of the at least two switches (e.g., switch SW2) is coupled to one terminal of the opening of the at least two wires (e.g., one terminal of 132 of the opening 131 of the wire 130) and one terminal of the opening of another one of the at least two wires (e.g., one terminal of 143 of the opening 141 of the wire 140) in an interlaced manner.

In some embodiments, the at least two wires can be wires in different layers. In some embodiments, one of the at least two wires can be disposed opposite to another one of the at least two wires (e.g., one of the at least two wires can be disposed above another one of the at least two wires).

If the one of the at least two switches (e.g., switch SW1) is turned on, the one of the at least two wires (e.g., wire 130) forms an inductor. If the another one of the at least two switches (e.g., switch SW2) is turned on, all of the at least two wires (e.g., wires 130, 140) and even all wires in FIG. 1 (e.g., wires 110-160) form the inductor.

In one embodiment, another terminal of the opening (e.g., another terminal 133 of the opening 131) of the one of the at least two wires (e.g., wire 130) is coupled to one terminal of the opening (e.g., another terminal 142 of the opening 141) of the another one of the at least two wires (e.g., wire 140).

In another embodiment, the inductor device 100 includes wires 110, 120, 130, 140, 150, 160, and switches SW1 and SW2. The wires 110-160 includes openings 111, 121, 131, 141, 151, 161 respectively. In one embodiment, one of the switches SW1, SW2 may be, but not limited to, a Bipolar Junction Transistor (BJT), a Metal-Oxide-Semiconductor Field-Effect Transistor (MOSFET), and another kind of transistor. In one embodiment, if one of the switches SW1/SW2 is implemented as a transistor, the transistor is configured to receive a control voltage, in which the control voltage is received by gate or base of transistor. When the switches SW1, SW2 are turned on, the control voltage is used to control an equivalent resistance so as to adjust current flows through the inductor device 100, which let the inductor device 100 have different inductances.

With respective to structure, the switch SW1 is coupled to two terminals 132, 133 of the opening 131 of the wire 130, and the switch SW2 is coupled to one terminal of 132 of the opening 131 of the wire 130 and one terminal of 143 of the opening 141 of the wire 140 in an interlaced manner. Specifically, the opening 131 includes an opening terminal 132 and an opening terminal 133, and opening 141 includes an opening terminal 142 and an opening terminal 143. The switch SW1 is coupled to the opening terminal 132 and the opening terminal 133 of the opening 131, and the switch SW2 is coupled to the opening terminal 132 of the opening 131 and the opening terminal 143 of the opening 141. In one embodiment, the opening terminal 132 of the opening 131 and the opening terminal 142 of the opening 141 are located at the same side (i.e., the left side as shown in the figure), and the opening terminal 133 of the opening 131 and the opening terminal 143 of the opening 141 are located at the same side (i.e., the right side as shown in the figure).

If the switch SW1 is turned on, part of the wires 110-160 form an inductor. For example, when the switch SW1 is turned on, two terminals 132, 133 of the opening 131 of the wire 130 is connected through the switch SW1, in this situation, the wires 110-130 form the inductor. On the other hand, if the switch SW2 is turned on, all of the wires 110-160 form the inductor. For example, when the switch SW2 is turned on, one terminal of 132 of the opening 131 of the wire 130 and one terminal of 143 of the opening 141 of the wire 140 are connected, in this situation, all of the wires 110-160 form the inductor.

In one embodiment, the inductor device 100 further includes an input terminal 180. If a middle point 190 of the inductor device 100 is used as the basis, the input terminal 180 is disposed at the first side (e.g., the lower side of the figure) of the inductor device 100, and the opening 111-161 is disposed at a second side (e.g., the upper side of the figure) corresponding to the first side of the inductor device 100.

In another embodiment, the input terminal 180 is disposed at the wire 110 for connecting to another device. The opening 111 of the wire 110 and the opening 121 of the wire 120 are coupled to each other in an interlaced manner, and the opening terminal 133 of the opening 131 of the wire 110 and the opening terminal 142 of the opening 141 of the wire 140 are coupled to each other. In addition, the opening 151 of the wire 150 and the opening 161 of the wire 160 are coupled to each other in an interlaced manner.

In another embodiment, the wires 120-150 further includes openings 125, 135, 145, 155 respectively, and the openings 125-155 are disposed at the first side (e.g., the lower side of the figure) of the inductor device 100. The opening 125 of the wire 120 and the opening 135 of the wire 130 are coupled to each other in an interlaced manner, and the opening 145 of the wire 140 and the opening 155 of the wire 150 are coupled to each other in an interlaced manner.

When the switch SW1 is turned on, two terminals 132, 133 of the opening 131 of the wire 130 are connected through the switch SW1, and the structure of the inductor is described as shown below. It is wound from the left side of the input terminal 180 to the wire 110, and it is wound to the second side (e.g., the upper side of the figure) of the inductor device 100. Then, it is wound to the wire 120 in an interlaced manner. Subsequently, it is wound to the first side (e.g., the lower side of the figure) of the inductor device 100, and then it is wound to the wire 130. Next, it is wound to the second side of the inductor device 100, and then one terminal 132 of the opening 131 of the wire 130 is coupled to another terminal 133 through the switch SW1. Subsequently, it is wound to the first side of the inductor device 100 along the wire 130, and then it is wound to the wire 120. Next, it is wound to the second side of the inductor device 100, and then it is wound to the wire 110. Finally, it is wound out from the right terminal of the input terminal 180."

On the other hand, when the switch SW2 is turned on, one terminal 132 of the opening 131 of the wire 130 and one terminal 143 of the opening 141 of the wire 140 are connected, and the structure of the inductor is be described as shown below. "It is wound from the left side of the input terminal 180 to the wire 110, and it is wound to the second side (e.g., the upper side of the figure) of the inductor device 100. Then it is wound to the wire 120 in an interlaced manner. Subsequently, it is wound to the first side (e.g., the lower side of the figure) of the inductor device 100, and then it is wound to the wire 130 in an interlaced manner. Next, it is wound to the second side of the inductor device 100, and then one terminal 132 of the opening 131 of the wire 130 is coupled to one terminal 143 of the opening 141 through the switch SW2. Subsequently, it is wound to the first side of the inductor device 100 along the wire 140, and then it is wound to the wire 150 in an interlaced manner. Next, it is wound to the second side of the inductor device 100, and then it is wound to the wire 160 in an interlaced manner. Subsequently, it is wound around middle point 190, and it is wound back to the second side of the inductor device 100. Next, it is wound to the wire 150 in an interlaced manner, and then it is wined to the first side of the inductor device 100 and wined to the wire 140 in an interlaced manner. Subsequently, it is wound to the second side of the inductor device 100, and then, it is wound to the wire 130 and wound to the first side of the inductor device 100. Next, it is wound to the wire 120 in an interlaced manner, and then it is wined to the second side of the inductor device 100. Subsequently, it is wound to the wire 110 in an interlaced manner, and it is finally wound out from the right terminal of the input terminal 180."

Figure 3:
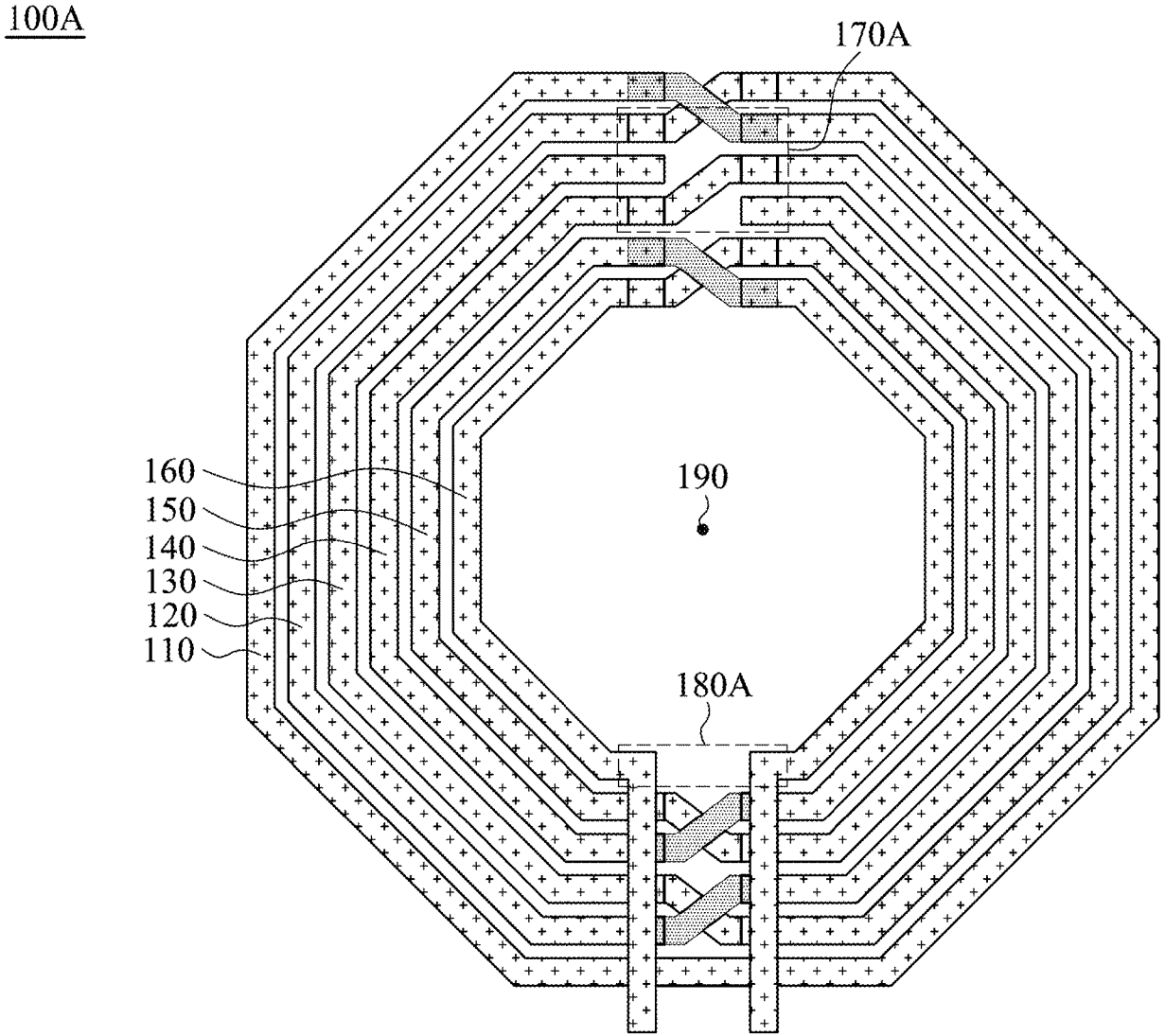
FIG. 3 is a schematic diagram of an inductor device according to some embodiments of the present disclosure.
Figure 4:
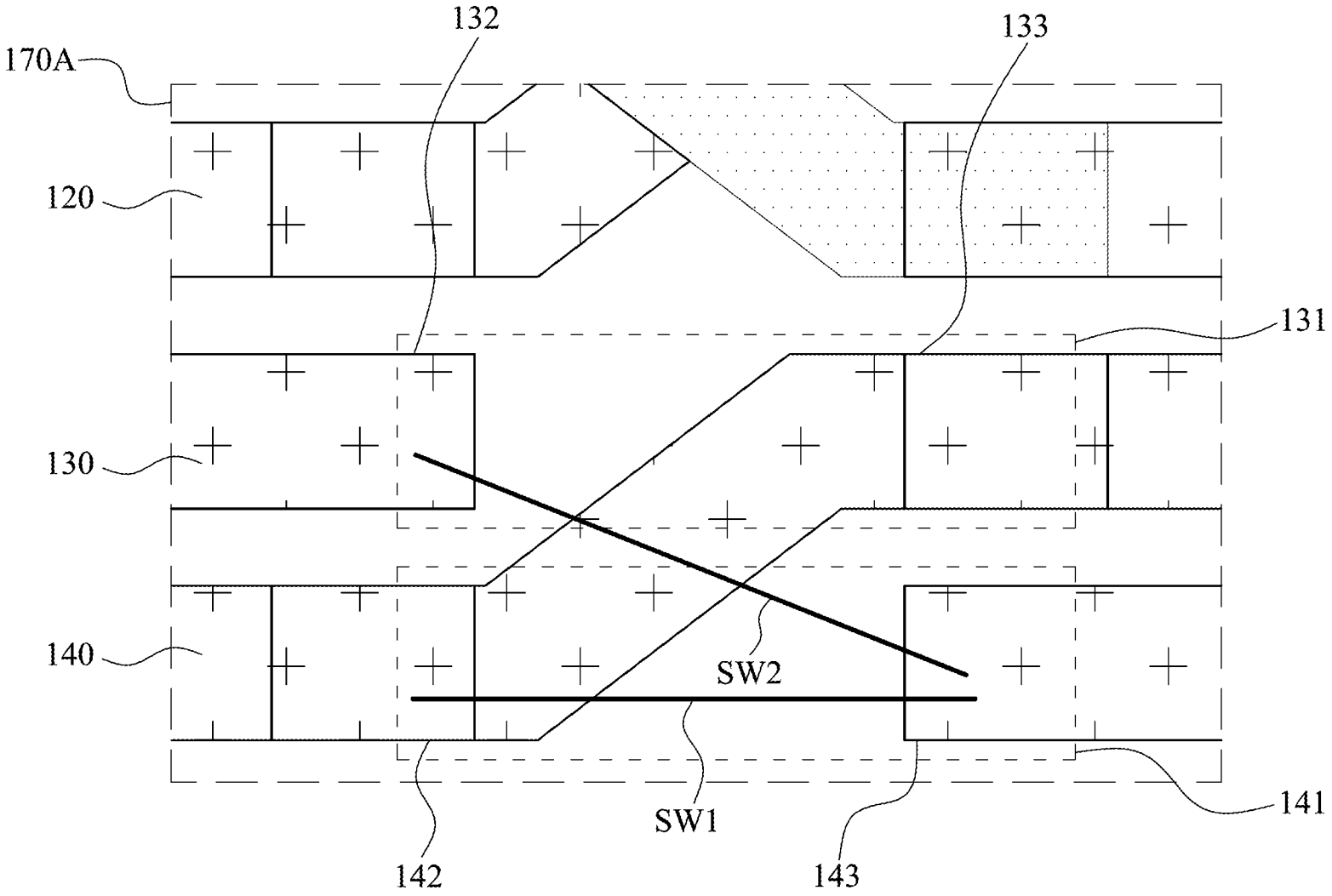
FIG. 4 is a schematic diagram of part of a circuit of an inductor device as shown in FIG. 3 according to some embodiments of the present disclosure.

FIG. 3 is a schematic diagram of an inductor device 100A according to some embodiments of the present disclosure. FIG. 4 is an amplified schematic diagram of part of a circuit 170A of the inductor device 100A as shown in FIG. 3 according to some embodiments of the present disclosure. It is noted that the inductor device 100A as shown in FIG. 3 is substantially similar to the inductor device 100 as shown in FIG. 1. The difference between the inductor device 100 as shown in FIG. 1 and the inductor device 100A as shown in FIG. 3 is that the connection of the switch SW1, the switch SW2, and the input terminal 180A, which will be described below.

Referring to both FIG. 3 and FIG. 4, with respect to the structure, the switch SW1 is coupled to two terminals 142, 143 of the opening 141 of the wire 140, and the switch SW2 is coupled to one terminal 132 of the opening 131 of the wire 130 and one terminal 143 of the opening 141 of the wire 140 in an interlaced manner. Specifically, the opening 131 includes an opening terminal 132 and an opening terminal 133, and the opening 141 includes an opening terminal 142 and an opening terminal 143. The switch SW1 is coupled to the opening terminal 142 and the opening terminal 143 of the opening 141, and the switch SW2 is coupled to the opening terminal 132 of the opening 131 and the opening terminal 143 of the opening 141. In addition, the input terminal 180A in FIG. 3 is disposed at the first side (e.g., the lower side as shown in the figure) of the inductor device 100, and disposed at the wire 160 for connecting to other devices.

If the switch SW1 is turned on, part of the wires 110-160 form an inductor. For example, when the switch SW1 is turned on, two terminals 142, 143 of the opening 141 of the wire 140 are connected through the switch SW1, and in this situation, the wires 140, 150 and 160 form the inductor. On the other hand, if the switch SW2 is turned on, the wires 110-160 form the inductor. For example, when the switch SW2 is turned on, one terminal 132 of the opening 131 of the wire 130 and one terminal 143 of the opening 141 of the wire 140 are connected to each other, and in this situation, the wires 110-160 form the inductor.

When the switch SW1 is turned on, two terminals 142, 143 of the opening 141 of the wire 140 are connected through the switch SW1, and the structure of the inductor is described as shown below. "It is wound from the left side of the input terminal 180A to the wire 160, and it is wound to the second side (e.g., the upper side of the figure) of the inductor device 100A. Then it is wound to the wire 150 in an interlaced manner. Subsequently, it is wound to the first side (e.g., the lower side of the figure) of the inductor device 100A, and then it is wound to the wire 140. Next, it is wound to the second side of the inductor device 100A, and then one terminal 142 of the opening 141 of the wire 140 is coupled to another terminal 143 through the switch SW1. Subsequently, it is wound to the first side of the inductor device 100A along the wire 140, and then it is wound to the wire 150 in an interlaced manner. Next, it is wound to the second side of the inductor device 100A, and then it is wound to the wire 160. Finally, it is wound out from the right terminal of the input terminal 180A."

On the other hand, when the switch SW2 is turned on, one terminal 132 of the opening 131 of the wire 130 and one terminal 143 of the opening 141 of the wire 140 are connected. The structure of the inductor is described as shown below. "It is wound from the left side of the input terminal 180A to the wire 160, and it is wound to the second side (e.g., the upper side of the figure) of the inductor device 100A. Then it is wound to the wire 150 in an interlaced manner. Subsequently, it is wound to the first side (e.g., the lower side of the figure) of the inductor device 100A, and then it is wound to the wire 140 in an interlaced manner. Next, it is wound to the second side of the inductor device 100A, and then it is wound to the wire 130 in an interlaced manner. Then, it is wound to the first side of the inductor device 100A, and wound to the wire 120 in an interlaced manner. Subsequently, it is wound to the second side of the inductor device 100A, and then wound to wire 110. Next, it is wound a whole wire as the basis of the middle point 190, and it is back to the second side of the inductor device 100A. Subsequently, it is wound to the wire 120 in an interlaced manner, and then it is wined to the first side of the inductor device 100A and wined to the wire 130 in an interlaced manner. Next, it is wound to the second side of the inductor device 100A, and then one terminal 132 of the opening 131 of the wire 130 is coupled to one terminal 143 of the opening 141 of the wire 140 through the switch SW2. Subsequently, it is wound to the first side of the inductor device 100A, and then, it is wound to the wire 150 and wound to the second side of the inductor device 100A. Next, it is wound to the wire 160 in an interlaced manner, and it is finally wound out from the right terminal of the input terminal 180A."

Figure 5:
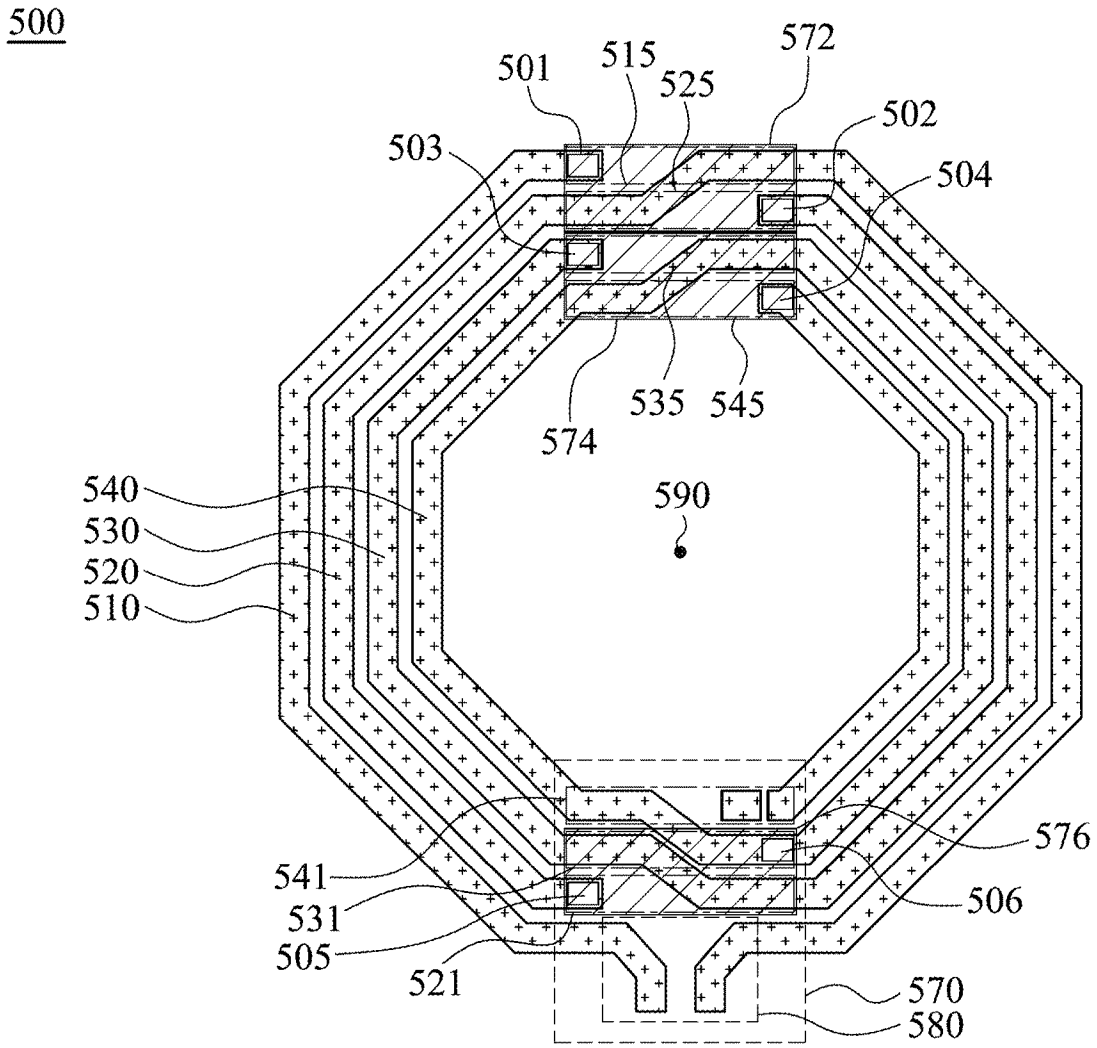
FIG. 5 is a schematic diagram of part of a circuit of an inductor device according to some embodiments of the present disclosure.
Figure 6:
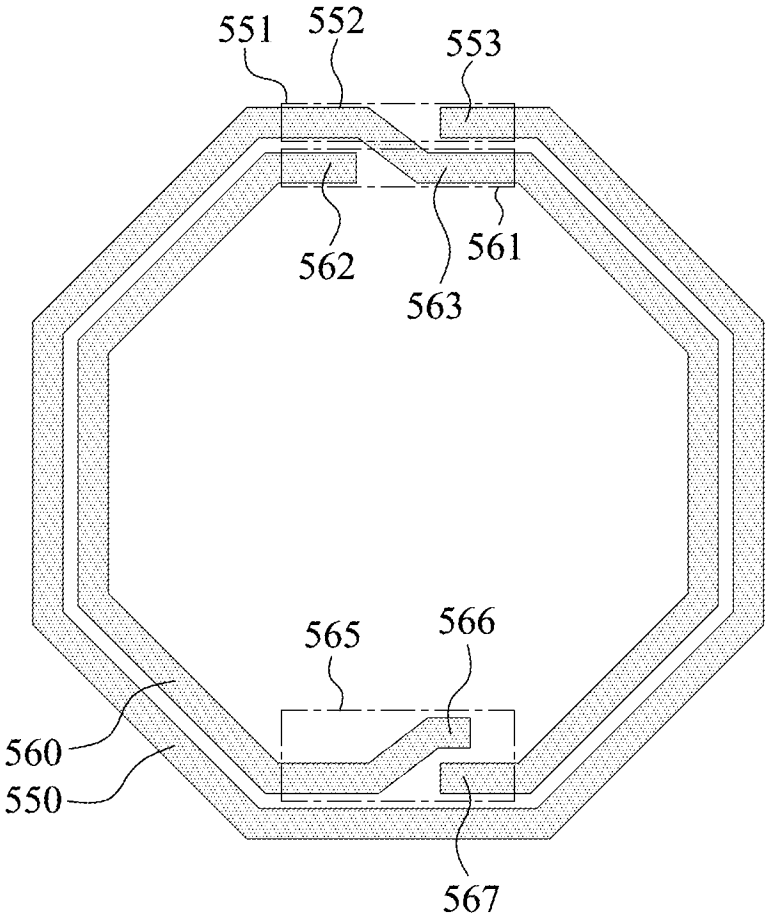
FIG. 6 is a schematic diagram of part of a circuit of an inductor device according to some embodiments of the present disclosure.
Figure 7:
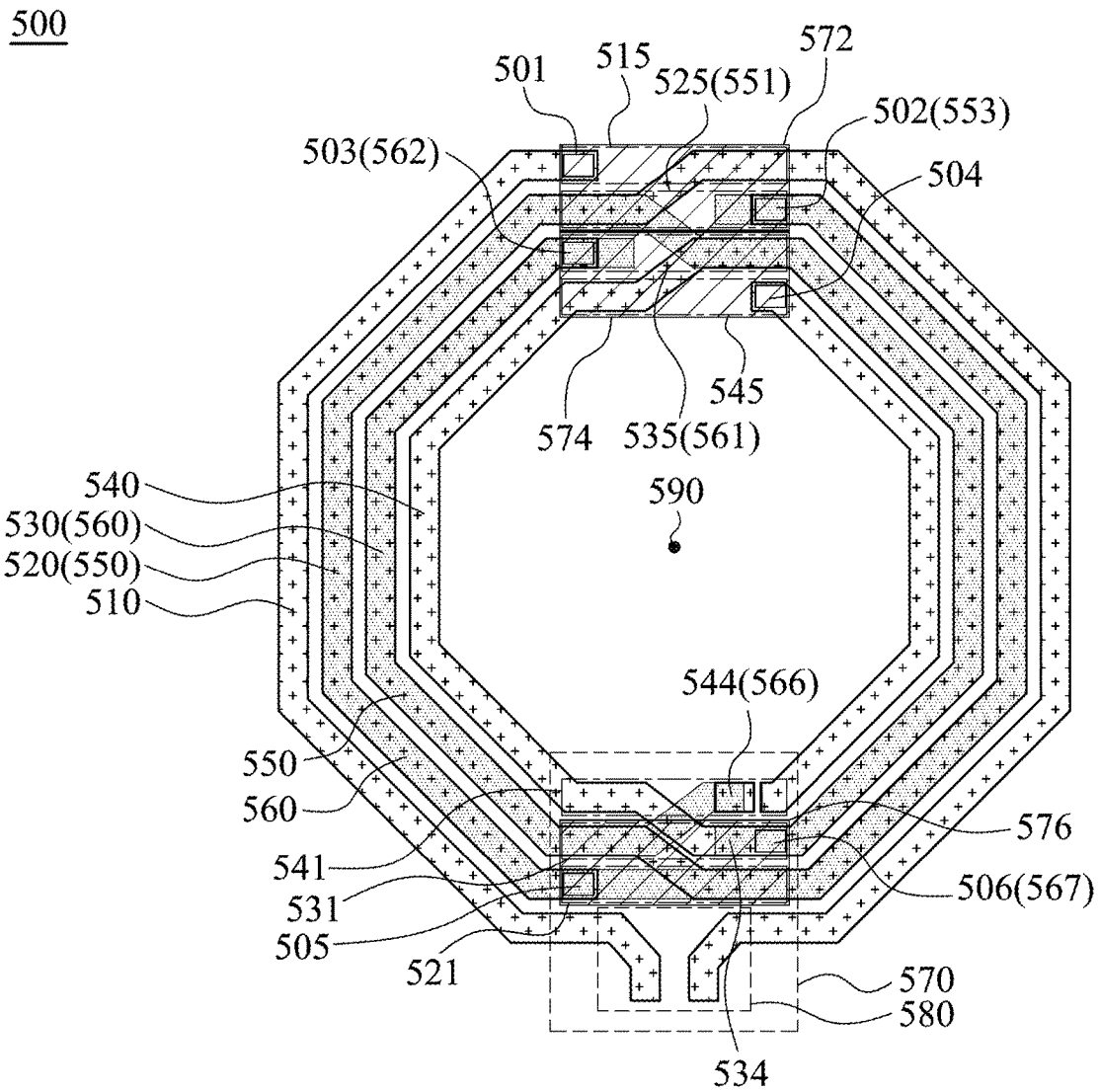
FIG. 7 is a schematic diagram of an inductor device according to some embodiments of the present disclosure.

FIG. 5 is a schematic diagram of part of a circuit of an inductor device 500 according to some embodiments of the present disclosure. FIG. 6 is a schematic diagram of part of a circuit of an inductor device 500 according to some embodiments of the present disclosure. FIG. 7 is a schematic diagram of an inductor device 500 according to some embodiments of the present disclosure. It is noted that the four-wire structure in FIG. 5 and the two-wire structure in FIG. 6 are combined to form the inductor device 500 shown in FIG. 7. In addition, FIG. 8 is an amplified schematic diagram of part of a circuit 570 of the inductor device 500 in FIG. 7 according to some embodiments of the present disclosure.

For facilitating understanding of the inductor device 500 in FIG. 7, the inductor device 500 is departed into the four-wire structure in FIG. 5 and the two-wire structure in FIG. 6. First of all, referring to FIG. 5, the four-wire structure includes wires 510, 520, 530, 540. The wire 510 includes an input terminal 580. The wires 520-540 include openings 521, 531, 541 respectively. In addition, the wires 510-540 further include openings 515, 525, 535, 545 respectively. If a middle point 590 of the inductor device 500 is used as the basis, the input terminal 580 and the openings 521-541 are disposed at the first side (e.g., the lower side of the figure) of the inductor device 500, and the openings 515-545 are disposed at a second side (e.g., the upper side of the figure) corresponding to the first side of the inductor device 500.

In addition, the four-wire structure further includes connection components 572, 574 and 576. One terminal of the opening 515 of the wire 510 is coupled to one terminal of the opening 525 of the wire 520 by the connection components 572. Specifically, the connection component 572 is coupled to one terminal of the opening 515 of the wire 510 through a connection point 501, and the connection component 572 is coupled to one terminal of the opening 525 of the wire 520 through a connection point 502. As such, one terminal of the opening 515 is coupled to one terminal of the opening 525 by the connection component 572. Similarly, one terminal of the opening 535 of the wire 530 (at the location of the connection point 503) is coupled to one terminal of the opening 545 (at the location of the connection point 504) by the connection component 574. Similarly, one terminal of the opening 521 of the wire 520 (at the location of the connection point 505) is coupled to one terminal of the opening 531 of the wire 530 (at the location of the connection point 506) by the connection component 576.

Figure 8:
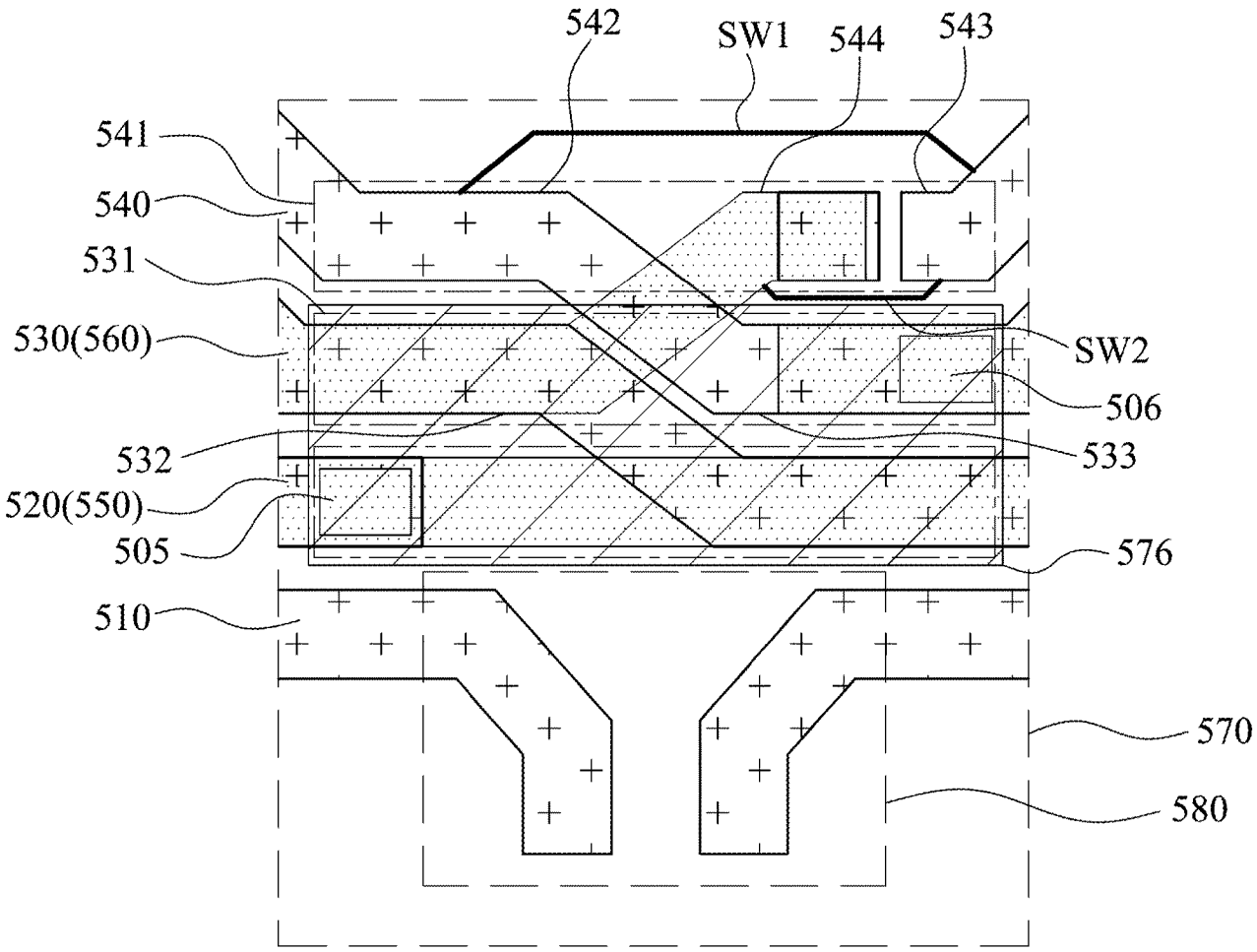
FIG. 8 is a schematic diagram of part of a circuit of an inductor device as shown in FIG. 7 according to some embodiments of the present disclosure.

Reference is now made to FIG. 8, the inductor device 500 including a switch SW1 is shown. The switch SW1 is coupled to terminals 542, 543 of the opening 541 of the wire 540. Reference is also made to FIG. 5. When the switch SW1 is turned on, two terminals 542, 543 of the opening 541 of the wire 540 are connected through the switch SW1. The structure of the inductor is described as shown below. "It is wound from the left side of the input terminal 580 into the wire 510, and it is wound to one side (e.g., the upper side of the figure) of the inductor device 500. Then it is coupled to the wire 520 through the connection component 572 (the path is from the connection point 501 to the connection point 502). Subsequently, it is wound to another side (e.g., the lower side of the figure) of the inductor device 500, and then it is wound to wire 530 in an interlaced manner. Next, it is wound to one side of the inductor device 500, and then it is coupled to the wire 540 through the connection component 574 (the path is from the connection point 503 to the connection point 504). Subsequently, it is wound to another side of the inductor device 500, and then two terminals 542, 543 of the opening 541 of the wire 540 are coupled through the switch SW1. Next, it is wound to one side of the inductor device 500 through the wire 540, and then it is wound to the wire 530 in an interlaced manner. Subsequently, it is wound to the wire 520 through connection component 576 (the path is from the connection point 506 to the connection point 505), and then it is wound to one side of the inductor device 500 and wound to the wire 510 in an interlaced manner. Finally, it is wound out from the right terminal of the input terminal 580."

Reference is now made to FIG. 6 and FIG. 7. Two-wire structure in FIG. 6 includes a wire 550 and a wire 560. With respect to structure, one terminal 553 of the opening 551 of the wire 550 is coupled to another terminal of the opening 525 of the wire 520 (at the location of the connection point 502), and another terminal 552 of the opening 551 of the wire 550 is coupled to one terminal of 563 of the opening 561 of the wire 560 in an interlaced manner. In addition, another terminal 562 of the opening 561 of the wire 560 is coupled to another terminal (at the location of the connection point 503) of the opening 535 of the wire 530. In addition, the opening 565 of the wire 560 is disposed at first side (i.e., the lower side as shown in the figure) of the inductor device 500, one terminal 566 of the opening 565 of the wire 560 is coupled to one terminal 544 of the opening 541 of the wire 540, and another terminal 567 of the opening 565 of the wire 560 is coupled to another terminal (at the location of the connection point 506) of the opening of the wire 530.

Referring to FIG. 8, the inductor device 500 including a switch SW2 is shown. The switch SW2 is coupled to the terminal 543 of the opening 541 of the wire 540 and the terminal 544 of an opening of the wire 560. Referring to FIGS. 5-8, when the switch SW2 is turned on, the terminal 543 of the opening 541 of the wire 540 and the terminal 544 of the opening of the wire 560 are connected through the switch SW2, and in this situation, the inductor extends from the wires 510-540 of the first layer to the wires 550-560 of the second layer through the switch SW2, such that the wires 510-560 form the inductor.

Figure 9:
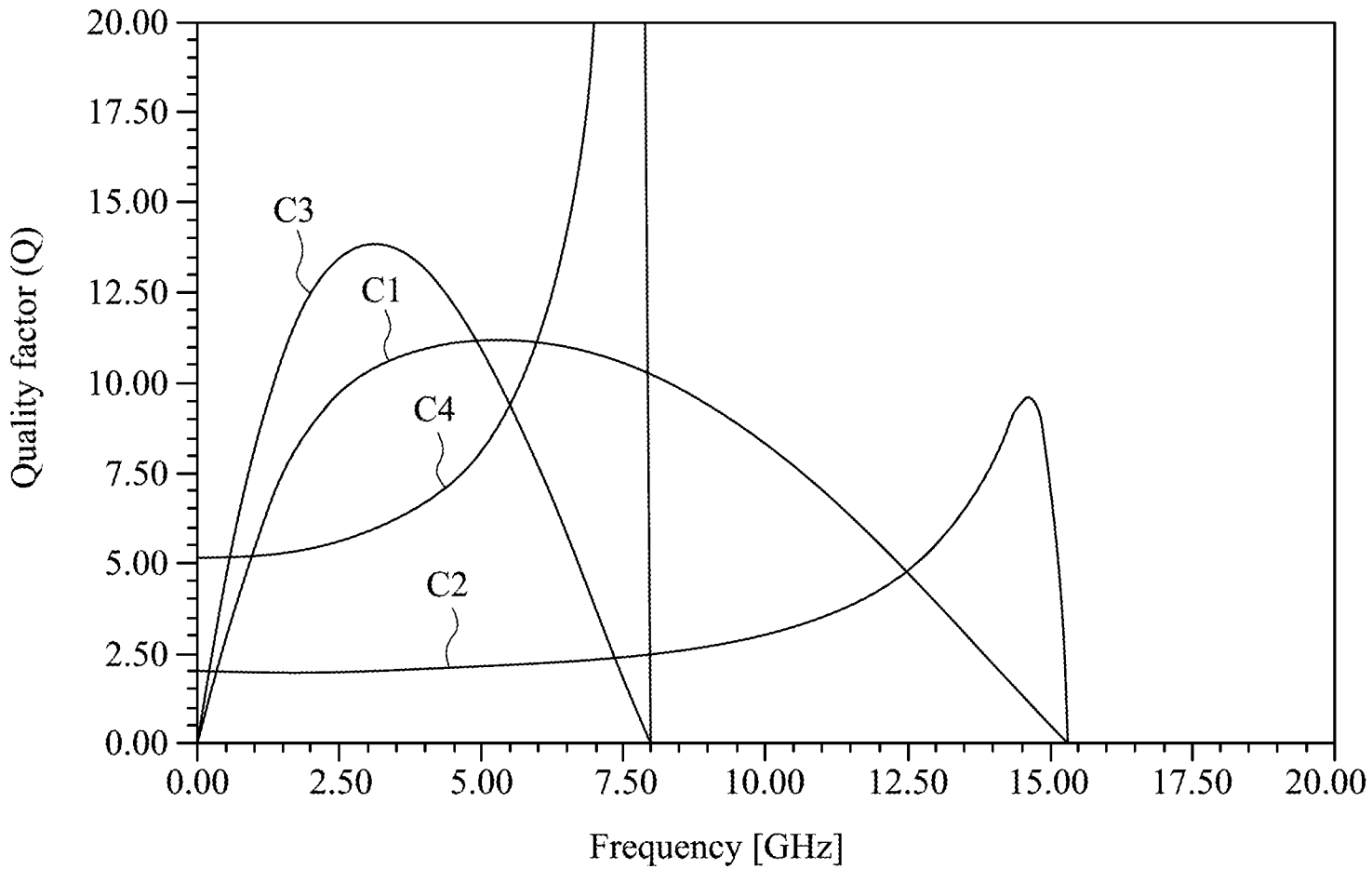
FIG. 9 depicts an experimental data diagram of an inductor device according to some embodiments of this disclosure.

FIG. 9 depicts an experimental data diagram of an inductor device according to some embodiments of this disclosure. The experimental data diagram is used for illustrating a quality factor and an inductance of the inductor device under different frequencies. As shown in the figure, curve C1 is a curve line that shows the quality factor of the inductor device when the switch SW1 is turned on. Curve C2 is a curve line that shows the inductance of the inductor device when the switch SW1 is turned on correspondingly. It is thus known from the experimental data shown in FIG. 9 that the quality factor of the inductor device can be about 11 when the switch SW1 is turned on. In addition, curve C3 is a curve line that shows the quality factor of the inductor device when the switch SW2 is turned on. Curve C4 is a curve line that shows the inductance of the inductor device when the switch SW2 is turned on correspondingly. It is thus known from the experimental data shown in FIG. 9 that the quality factor of the inductor device can be about 14 when the switch SW2 is turned on. In addition, it is thus known from FIG. 9 that on conditions of the switch SW1 being turned on or of the switch SW2 being turned on, the inductances of the inductor device are different. Therefore, the inductor device is suitable for systems/devices which need to be switched between different frequency bands (e.g., systems/devices need to be switched between 2.4 GHz and 5 GHz).

Therefore, the present disclosure is suitable for systems/devices which need to be switched between different frequency bands by adjusting the inductance of the inductor device, so as to broaden the applications of the inductor device.

What is claimed is:

1. An inductor device, comprising:

at least two wires, wherein each of the at least two wires comprises an opening, and the openings are disposed correspondingly to each other; and at least two switches, wherein one of the at least two switches is coupled to two terminals of the opening of one of the at least two wires, another one of the at least two switches is coupled to one terminal of the opening of the one of the at least two wires and one terminal of the opening of another one of the at least two wires in an interlaced manner;

wherein if the one of the at least two switches is turned on, the one of the at least two wires forms an inductor; if the another one of the at least two switches is turned on, both of the at least two wires form the inductor.

2. The inductor device of claim 1, wherein another terminal of the opening of the one of the at least two wires is coupled to another terminal of the opening of the another one of the at least two wires.

3. The inductor device of claim 2, wherein the at least two wires comprises:

a first wire, comprising a first opening, wherein the first opening comprises a first terminal and a second terminal; and a second wire, comprising a second opening, wherein the second opening comprises a first terminal and a second terminal, wherein the second terminal of the first opening of the first wire is coupled to the first terminal of the second opening of the second wire in an interlaced manner.

4. The inductor device of claim 3, wherein the at least two switches comprise:

a first switch, comprising a first terminal and a second terminal, wherein the first terminal of the first switch is coupled to the first terminal of the first opening, and the second terminal of the first switch is coupled to the second terminal of the first opening; and a second switch, comprising a first terminal and a second terminal, wherein the first terminal of the second switch is coupled to the first terminal of the first opening, and the second terminal of the second switch is coupled to the second terminal of the second opening, wherein if the first switch is turned on and the first terminal of the first switch is conducted to the second terminal, the first wire forms the inductor; if the second switch is turned on and the first terminal of the second switch is conducted to the second terminal, both of the first wire and the second wire form the inductor.

5. The inductor device of claim 1, wherein one of the at least two switches is a transistor, and the transistor is configured to receive a control voltage, wherein, the control voltage is configured to determine an equivalent resistance of the transistor.

6. An inductor device, comprising:

a plurality of wires, wherein each of at least two wires of the wires comprises an opening, and the openings are disposed correspondingly to each other;

a first switch coupled to two terminals of the opening of one of the at least two wires; and a second switch coupled to one terminal of the opening of the one of the at least two wires and one terminal of the opening of another one of the at least two wires in an interlaced manner;

wherein if the first switch is turned on, part of the wires form an inductor; if the second switch is turned on, all of the wires form the inductor.

7. The inductor device of claim 6, further comprising an input terminal, wherein the wires comprise a first wire, a second wire, a third wire, a fourth wire, a fifth wire and a sixth wire, and the first to the sixth wires respectively comprises a first to a sixth openings, wherein on a basis of a middle point of the inductor device, the input terminal is disposed at a first side of the inductor device, and the first to the sixth openings are disposed at a second side corresponding to the first side of the inductor device.

8. The inductor device of claim 7, wherein the input terminal is disposed at the first wire, wherein the first opening of the first wire and the second opening of the second wire are coupled to each other in an interlaced manner, and the fifth opening of the fifth wire and the sixth opening of the sixth wire are coupled to each other in an interlaced manner, wherein the first switch is coupled to two terminals of the third opening of the third wire, and the second switch is coupled to one terminal of the fourth opening of the fourth wire and one terminal of the third opening of the third wire.

9. The inductor device of claim 8, wherein the third opening comprises a first terminal and a second terminal, and the fourth opening comprises a first terminal and a second terminal, wherein the first switch is coupled to the first terminal and the second terminal of the third opening, and the second switch coupled to the first terminal of the third opening and the second terminal of the fourth opening.

10. The inductor device of claim 9, wherein the first terminal of the third opening and the first terminal of the fourth opening are disposed at the same side, and the second terminal of the third opening and the second terminal of the fourth opening are disposed at the same side, wherein the second terminal of the third opening is coupled to the first terminal of the fourth opening.

11. The inductor device of claim 10, wherein the second to the fifth wires further comprise a seventh to a tenth openings respectively, and the seventh to the tenth openings are disposed at the first side of the inductor device, wherein the seventh opening of the second wire and the eighth opening of the third wire are coupled to each other in an interlaced manner, and the ninth opening of the fourth wire and the tenth opening of the fifth wire are coupled to each other in an interlaced manner.

12. The inductor device of claim 7, wherein the input terminal is located at the sixth wire, wherein the first opening of the first wire and the second opening of the second wire are coupled to each other in an interlaced manner, and the fifth opening of the fifth wire and the sixth opening of the sixth wire are coupled to each other in an interlaced manner, wherein the first switch is coupled to two terminals of the fourth opening of the fourth wire, and the second switch is coupled to one terminal of the third opening of the third wire and one terminal of the fourth opening of the fourth wire.

13. The inductor device of claim 12, wherein the third opening comprises a first terminal and a second terminal, and the fourth opening comprises a first terminal and a second terminal, wherein the first switch is coupled to the first terminal and the second terminal of the fourth opening, and the second switch is coupled to the first terminal of the third opening and the second terminal of the fourth opening.

14. The inductor device of claim 13, wherein the first terminal of the third opening and the first terminal of the fourth opening are located at the same side, and the second terminal of the third opening and the second terminal of the fourth opening are located at the same side, wherein the second terminal of the third opening is coupled to the first terminal of the fourth opening.

15. The inductor device of claim 14, wherein the second to the fifth wires further comprise a seventh to a tenth openings respectively, and the seventh to the tenth openings are disposed at the first side of the inductor device, wherein the seventh opening of the second wire and the eighth opening of the third wire are coupled to each other in an interlaced manner, and the ninth opening of the fourth wire and the tenth opening of the fifth wire are coupled to each other in an interlaced manner.

16. The inductor device of claim 7, wherein the first wire to the fourth wire are disposed in a first layer, the fifth wire and the sixth wire are disposed in a second layer, and the first layer and the second layer are disposed in different layers, wherein if the first switch is turned on, the first wire to the fourth wire form an inductor; if the second switch is turned on, all of the first wire to the sixth wire form the inductor.

17. The inductor device of claim 16, further comprises a first connection component and a second connection component, wherein the input terminal is disposed at the first wire, wherein one terminal of the first opening of the first wire and one terminal of the second opening of the second wire are coupled to each other in an interlaced manner, another terminal of the first opening of the first wire and another terminal of the second opening of the second wire are coupled to each other through the first connection component, one terminal of the third opening of the third wire and one terminal of the fourth opening of the fourth wire are coupled to each other in an interlaced manner, and another terminal of the third opening of the third wire and another terminal of the fourth opening of the fourth wire are coupled to each other in an interlaced manner through the second connection component.

18. The inductor device of claim 17, further comprises a third connection component, wherein the second to the fourth wires further comprise a seventh to a ninth openings respectively, and the seventh to the ninth openings are disposed at the first side of the inductor device, wherein one terminal of the seventh opening of the second wire and one terminal of the eighth opening of the third wire are coupled to each other in an interlaced manner, and another terminal of the seventh opening of the second wire and another terminal of the eighth opening of the third wire are coupled to each other through the third connection component.

19. The inductor device of claim 18, wherein one terminal of the fifth opening of the fifth wire is coupled to another terminal of the second opening of the second wire, and another terminal of the fifth opening of the fifth wire is coupled to one terminal of the sixth opening of the sixth wire in an interlaced manner, wherein another terminal of the sixth opening of the sixth wire is coupled to another terminal of the third opening of the third wire.

20. The inductor device of claim 19, wherein the sixth wire further comprises a tenth opening, and the tenth opening is disposed at the first side of the inductor device, wherein one terminal of the tenth opening of the sixth wire is coupled to one terminal of the ninth opening of the fourth wire, and another terminal of the tenth opening of the sixth wire is coupled to another terminal of the eighth opening of the third wire.

* * * * *